US008479972B2

(12) United States Patent
Craft et al.

(10) Patent No.: US 8,479,972 B2
(45) Date of Patent: Jul. 9, 2013

(54) EXPANDABLE FOOD CARTON

(75) Inventors: Rachel Lyn Craft, Glen Rock, NJ (US); Gladys Odette Sierra-Gomez, Woodbridge, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 287 days.

(21) Appl. No.: 12/761,758

(22) Filed: Apr. 16, 2010

(65) Prior Publication Data

US 2011/0253776 A1 Oct. 20, 2011

(51) Int. Cl.
*B65D 5/10* (2006.01)
*B65D 5/355* (2006.01)

(52) U.S. Cl.
USPC ..... 229/101; 229/112; 229/114; 229/123; 229/902; 229/906

(58) Field of Classification Search
USPC ..... 229/101, 112, 123, 125, 902, 904.1, 229/906, 931, 938, 114; 426/115
See application file for complete search history.

(56) References Cited

U.S. PATENT DOCUMENTS

| | | | | |
|---|---|---|---|---|
| 184,322 | A | 11/1876 | Benham | |
| 1,668,800 | A * | 5/1928 | Bonfield | 229/112 |
| 2,085,238 | A | 6/1937 | Towell | |
| 2,176,912 | A | 10/1939 | Luckett | |
| 2,279,614 | A | 4/1942 | Bryant | |
| 2,594,394 | A * | 4/1952 | Casselman et al. | 229/125 |
| 2,625,315 | A | 1/1953 | Fehrenkamp | |
| 2,686,002 | A | 8/1954 | Inman | |
| 2,793,802 | A * | 5/1957 | Scaturro | 229/123 |
| 2,903,180 | A | 9/1959 | Holmes | |
| 2,961,140 | A | 11/1960 | Holmes | |
| 3,512,698 | A | 5/1970 | Kapustka | |
| 3,809,310 | A | 5/1974 | VanderLugt, Jr. | |
| 4,022,372 | A * | 5/1977 | Graser | 229/931 |
| 4,063,679 | A | 12/1977 | Henry | |
| 4,714,190 | A | 12/1987 | Morrocco | |
| D296,747 | S | 7/1988 | Johnson | |
| 5,098,014 | A | 3/1992 | Perkins | |
| 5,292,058 | A | 3/1994 | Zoss et al. | |
| 5,381,949 | A | 1/1995 | Correll | |

(Continued)

OTHER PUBLICATIONS

Janosch, J.; European Search Report; EP11162736.0 dated Jul. 22, 2011; 3 pages.

(Continued)

*Primary Examiner* — Gary Elkins
(74) *Attorney, Agent, or Firm* — Fitch, Even, Tabin & Flannery LLP

(57) ABSTRACT

An expandable food carton expands to a non-trapezoidal shape when in an open and expanded state. The expanded state creates a wider top opening which provides a larger access to the interior of the package and thus to the food product. The expandable carton has a bottom end with upstanding side panels therefrom, where each side panel has at least one score line that extends between an upper end region and a lower end region. The carton has a top flap attached at an upper end of each side panel, each top flap also having a score line that extends longitudinally between an upper end region and a lower end region at a midpoint region. Upon shifting the carton into the expanded state, the side panels of the carton shift outward along their respective score lines and the top flaps of the carton fold down adjacent respective side panels and shift outward along their respective score lines.

20 Claims, 4 Drawing Sheets

U.S. PATENT DOCUMENTS

| | | | | |
|---|---|---|---|---|
| D407,970 | S | 4/1999 | Planchard | |
| 6,206,279 | B1 | 3/2001 | Countee | |
| 6,478,216 | B2 | 11/2002 | Wiart | |
| D469,691 | S | 2/2003 | Brondyke et al. | |
| 6,612,072 | B2 | 9/2003 | Busby et al. | |
| D482,614 | S | 11/2003 | Countee, Jr. | |
| 7,021,525 | B2 | 4/2006 | Jouppi et al. | |
| D523,744 | S | 6/2006 | Zeng | |
| D551,572 | S | 9/2007 | Hsu | |
| D551,967 | S | 10/2007 | Hengami | |
| 7,325,718 | B2 * | 2/2008 | Cook et al. | 229/125 |
| D563,155 | S | 3/2008 | Wyllie et al. | |
| D567,586 | S | 4/2008 | Brown | |
| D567,592 | S | 4/2008 | Fite, IV et al. | |
| D578,829 | S | 10/2008 | Freeman | |
| D580,779 | S | 11/2008 | Hartwell et al. | |
| D589,344 | S | 3/2009 | Lang | |
| D589,345 | S | 3/2009 | Lang | |
| D592,058 | S | 5/2009 | Rapaport | |
| D607,281 | S | 1/2010 | Meyers | |
| D611,341 | S | 3/2010 | Belce | |
| D640,932 | S | 7/2011 | Kasha | |
| 8,052,038 | B2 * | 11/2011 | Jackson | 229/123 |
| 2001/0004086 | A1 * | 6/2001 | Wiart | 229/101 |

OTHER PUBLICATIONS

Janosch, J.; European Search Opinion; EP11162736.0 dated Jul. 22, 2011; 3 pages.

* cited by examiner

EXPANDABLE FOOD CARTON

FIELD

This application generally relates to a food carton and, in particular, a food carton having an expandable top opening.

BACKGROUND

Snack foods, such as baked goods like cookies, crackers, cereals, and snack chips, are often packaged in a flexible bag or liner which is in turn packaged in a carton or paperboard box. Typically, the outer box is shaped as a rectangle or a rectangular parallelepiped. The parallelepiped box has a relatively narrow width allowing the package to be easily held in one hand and providing a large front and back panel for product identification. However, the width of the opening on top of the box is also relatively narrow due to the narrow width of the box and thus a consumer cannot easily insert a hand or other object to extract the snack food. Usually the box has to be deformed at the top of the box by the hand which is inserted into the package to allow the products to be removed from the package by hand. Once the hand is removed, the box returns to its initial shape. If the box is permanently deformed by the user to an extent such that a pressure was applied to force the box to stay open in a wider configuration, then it can be difficult to reclose the box.

Alternatively, a box utilizing a widened top shape for easy access to the packaged goods stored therein can also be found. The front and back panels of the box can contain folding score lines which fold the front and back panels outward to allow the top of the package to form an enlarged shape for easier access to the packaged goods. However, the box does not stay open during a prolonged amount of time. Additionally, the top flaps of the carton or box do not conveniently fold and remain out of the way when the top opening is expanded into an enlarged shape which can get in the way of a user trying to insert their hand or other object into the carton to extract the packaged good. One method of keeping the flaps out of the way has been to intentionally remove them by ripping or tearing them off; however, then the top opening of the box cannot be reclosed. Additionally, the method of initially opening a carton at the top, such as a perforation, flip-top, etc., can often eliminate the reclose properties of the top flaps upon the initial opening of the box via the top flaps.

SUMMARY

An expandable carton is provided having an expandable top with one or more score lines located on each of the carton's four side panels which can expand to form a larger top opening and an octagonal-shaped carton. In addition, each of its four top flaps also contains a score line that allow the top flaps to fold down adjacent its respective side panel and to remain in the folded configuration, below the plane of the carton opening, while the carton is in the expanded state. The major side panels of the carton can optionally comprise a trapezoidal shape, such that the bottom end is narrower than the top end. As a result, the minor side panels, which can be generally rectangular shaped, can be slightly angled outward when in the closed state. These side panels thus provide for a narrower bottom end of the carton as compared to the top end which can provide for ease of holding, while the wider top end can provide for easier access to the product inside of the carton, particularly when expanded.

Upon folding the carton outward along the score lines, the carton and the top opening of the carton can expand in size, thus increasing the area of the opening. This provides a consumer or user with a larger area into which to insert their hand while removing the food product from the interior of the carton. Additionally, since the top flaps also contain score lines, the top flaps can fold down against the adjacent side panels and remain out of the way upon expanding the carton and accessing the food product inside of the carton, i.e., while the carton is in the expanded state. Advantageously, the reclosability of the carton at the top flaps is maintained while at the same time not interfering with access to the interior of the carton. Thus, these features allow the top flaps to remain attached, yet conveniently fold out of the way when snacking. Furthermore, having each of the four side panels expandable outwardly about their respective fold or score lines advantageously can assist in maintaining the top flaps in a folded position adjacent the respectively-attached side panels due to the deformation of each of the side panels, as opposed to two of the side panels.

In its expanded state, the carton can maintain its standable features, such as a generally planar bottom. The carton easily converts from an initial closed state, such as where the carton can have a generally trapezoidal shape, to a widened shape on top for easy access to the snack product. The carton can remain in this widened and open configuration throughout hand-to-mouth snacking.

DETAILED DESCRIPTION

An expandable food carton is provided for expanding the opening of the food carton to allow for easier access of the contents stored therein, as described herein and illustrated in FIGS. 1-6. The food carton has a bottom with upstanding side panels, a pair of major side panels and a pair of minor side panels, and a top that is attached at upper ends of the side panels. The pair of major side panels can be generally parallel to each other and can have a wider upper end than lower end, while the pair of minor side panels can optionally angle slightly outward when in the closed state. The major and minor side panels can each be folded generally perpendicular to the bottom and are attached to the bottom at a lower end thereof. The side panels can each have at least one score line that extends between an upper end and a lower end thereat that allows for providing the carton in an expanded configuration. When the carton is closed, the top can have a generally rectangular shape defined by top flaps thereat. The carton can have a generally rectangular bottom shape with a larger perimeter rectangular top when in the closed state. The top flaps, comprising a pair of major top flaps and a pair of minor top flaps, also can each have at least one score line that extends between an upper end and a lower end of the top flaps. When the carton is opened and in the expanded configuration, the opening of the carton can have a non-rectangular configuration and, in particular, can have an octagonal shape. When the carton is in the expanded configuration, the side panels can be folded outward along their respective score lines and the top flaps can be folded down along their respective side panels and along their score lines.

Figure 1:
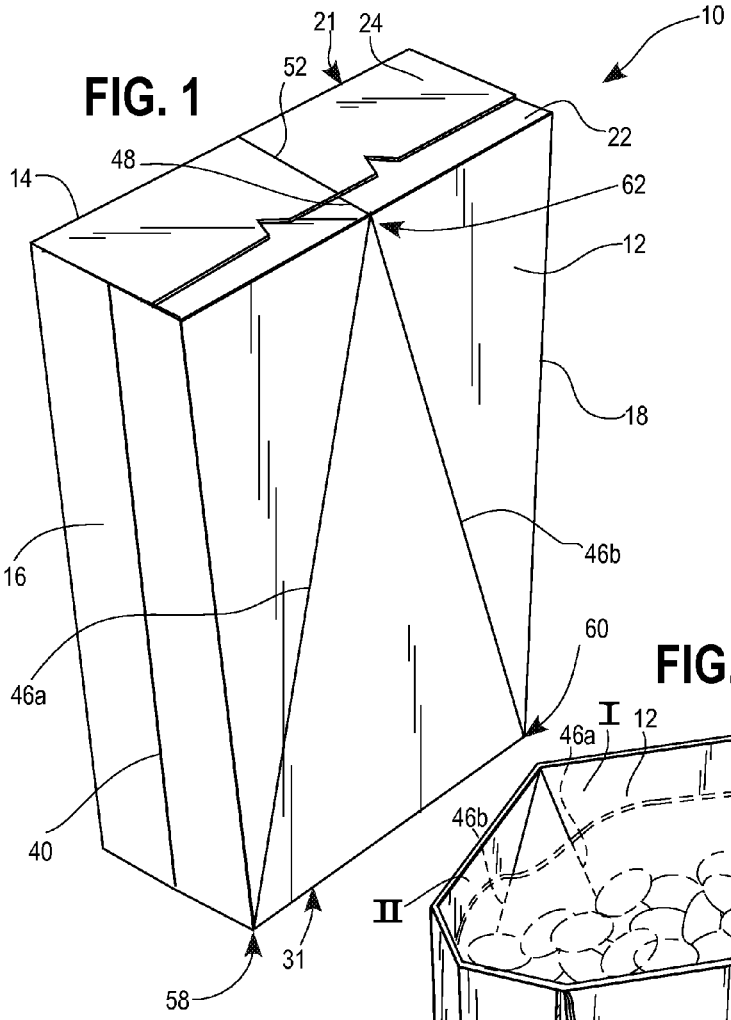
FIG. 1 is a perspective view of a trapezoidal-shaped food carton in a closed position.
Figure 2:
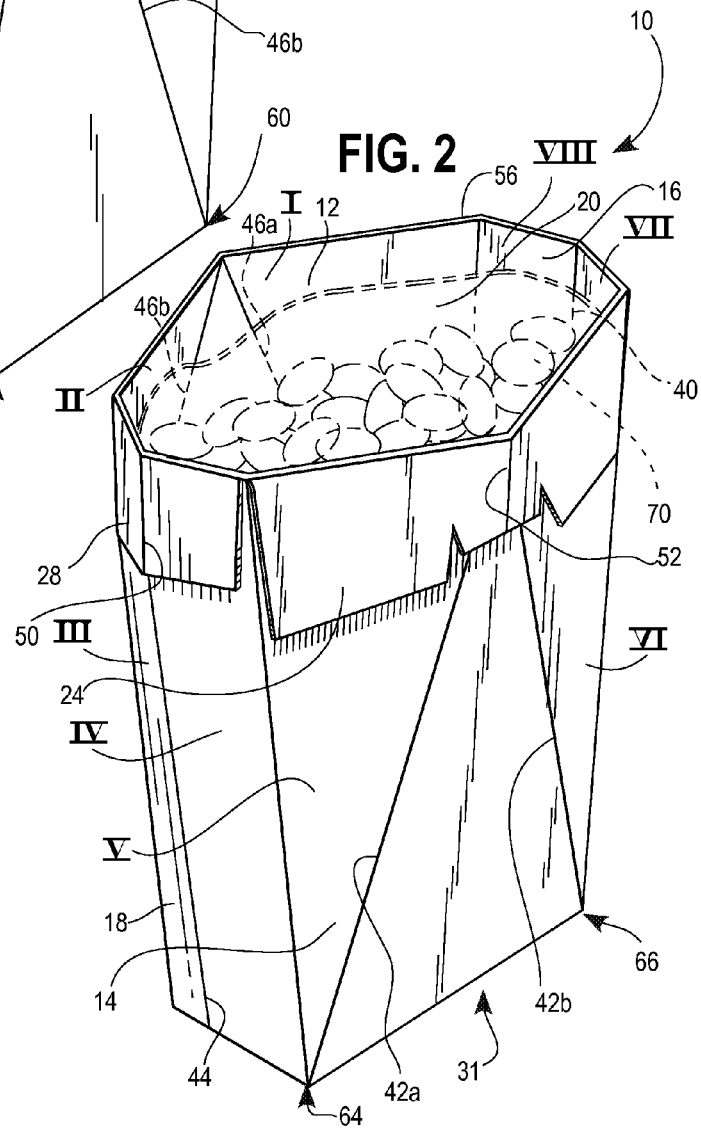
FIG. 2 is the trapezoidal-shaped food carton of FIG. 1 in an open and expanded position.

Turning to FIG. 1, an expandable carton 10 is shown in a closed state and in an unexpanded state. The carton 10 optionally has a generally trapezoidal shape, however, any similar shape, such as a parallelepiped shape, can be provided. The carton 10 can have a bottom 31 that is defined by a pair of major bottom flaps 30 and 34 and a pair of minor bottom flaps 32 and 36, which are folded and can be attached to form a substantially closed bottom. The bottom 31 can have a generally rectangular shape. Upstanding from the bottom 31 and attached thereto are a plurality of side panels, a front side panel 12, an opposing back side panel 14, with a first side panel 16 and a second side panel 18 extending between the front side panel 12 and the back side panel 14. At a lower end of the side panels 12, 14, 16, and 18, the side panels are attached to its respective bottom flap. For instance, the front side panel 12 is attached to the front bottom flap 30 at the lower end of the front side panel 12. Similarly, the back front panel 14, the first side panel 16 and the second side panel 18 are each attached at its lower end to either the back bottom flap 34, first side bottom flap 36, and the second side bottom flap 32, respectively.

The first and second side panels, or minor side panels, 16 and 18 can optionally angle slightly outward when in the closed state such that the minor side panels 16 and 18 are further apart at their upper end as compared to their lower end. In another aspect, the front and back side panels, or major side panels, 12 and 14 can optionally angle slightly outward when in the closed state such that the major side panels 12 and 14 are further apart at their upper end as compared to their lower end. In still another aspect, both the major and minor side panels can all optionally be angled slightly outward when in the closed state.

The carton 10 is shown in the closed state in FIG. 1, which comprises the top flaps folded over, generally perpendicular to the front side panel 12 and the back side panel 14, or the major side panels, and the first side panel 16 and the second side panel 18, or the minor side panels, to close the opening 56 of the carton 10 and form a closed top 21. Each top flap can be attached at a lower end of the flap to an upper end of its respective side panel. Therefore, the front top flap 22 is attached to the front side panel 12 at a lower end of the front top flap 22 and at an upper end of the front side panel 12. Similarly, the back top flap 24 is attached to the back side panel 14, the first side top flap 26 is attached to the first side panel 16, and the second side top flap 28 is attached to the second side panel 18.

Each of the top flaps 22, 24, 26, and 28 can have a score line 48, 50, 52, and 54, respectively, that extends longitudinally along its midpoint region from an upper edge region toward a lower edge region. In one aspect, the front top flap 22 can have a score or crease line 48 that extends from the upper edge to the lower edge in a longitudinal direction along the midpoint of the front top flap 22. Likewise for the remaining top flaps 24, 26 and 28.

The side panels 12, 14, 16, and 18 can also each contain at least one score line that extends between its upper end region and lower end region. In one aspect, the front side panel 12 and back side panel 14 each contain two score lines, while the first side panel 16 and the second side panel 18 each contain one score line. The first side panel 16 can have a first score line 40 that can generally be positioned along a midpoint region 96 of the first side panel 16 extending between the upper end region and lower end region. In one aspect, the first side panel score line 40 can extend from the lower end toward the upper end along the midpoint 96 of the first side panel 16. The second side panel 18 can also have a second score line 44 that extends between the upper end region and the lower end region of the second side panel 18 generally positioned along a midpoint region 98. In another aspect, the second side panel score line 44 extends from the lower end toward the upper end of the second side panel 18 along the midpoint 98. Optionally, the score lines 40 and 44 can each also extend into its associated bottom flap 36 and 32, respectively. For instance, score line 40 can continue past the lower end of the first side panel 16 into the bottom flap 36 to form score line 41 generally positioned along the midpoint region 96 and extending longitudinally between an upper end and a lower end of the bottom flap 36. Similarly, score line 44 can continue past the lower end of the second side panel 18 and into the bottom flap 32 to form score line 44, generally positioned along the midpoint region 98 and also extending longitudinally between an upper end and a lower end of the bottom flap 32.

The front side panel 12 can have two score lines 46*a* and 46*b*. The first score line 46*a* can extend from a first bottom corner region 58 toward a midpoint region 62 of the top end of the front side panel 12 and the second score line 48*a* can extend from a second bottom corner region 60 toward the midpoint region 62 of the top end. Similarly, the back side panel 14 can have two score lines 42*a* and 42*b*. The first score line 42*a* can extend from a first bottom corner region 64 toward a midpoint region 68 of the top end of the back side panel 14 and the second score line 42*b* can extend from a second bottom corner region 66 toward the midpoint region 68. In one aspect, the pair of score lines 42*a* and 42*b* on the back side panel 14 and the pair of score lines 46*a* and 46*b* on the front side panel 12 can each be shaped similar to an upside down 'V'.

Alternatively, any other configuration of score lines may be used, such as partial score lines that do not extend completely from the corners at the lower end to the upper end, a single score line, three score lines on one panel, and so on. Likewise, the front side panel 12 and the back side panel 14 may comprise a single score line that generally extends along a midpoint region, while the first side panel 16 and the second side panel 18 may comprise a pair of score lines, greater than two score lines, or any other variation.

After opening the top 21 of the carton 10, the carton 10 can be provided in the expanded state, as shown in FIGS. 2-5. To open the top 21 of the carton 10, the top flaps 22, 24, 26, and 28 can be opened. The top flaps 22, 24, 26, and 28 can be initially attached in a closed position, such as with adhesive, or can have a tear strip that must first be removed to expose the free-standing top flaps 22, 24, 26, and 28, or any other known attaching and opening method known in the art. In the aspect shown in FIG. 1, the major top flaps 22 and 24 are initially attached to each other and can then be separated by the user along the attached area to open the carton 10 and lift up the flaps. However, any other combination of attached flaps can be used, such as attaching all of the flaps to each other, and so on. After the initial opening of the carton 10, the top flaps can be reclosed and reopened numerous times, as will be discussed below.

Once the top 21 of the carton 10 is opened, its opening 56 is exposed, which can be defined by the upper ends of the major side panels 12 and 14 and the minor side panels 16 and 18. The opening 56 is opposite the bottom 31 of the carton 10. The opening 56 reveals the interior of the carton 10, which can contain an optional bag or liner 20, and contains a food product 70 therein.

To provide the carton 10 in its expanded configuration, the user can apply a pressure to the outside or exterior walls of the carton 10 in order to shift the carton 10 outward along its side panel score lines 40, 42*a*, 42*b*, 44, 46*a*, and 46*b*. In one aspect, the user can apply a pressure to both the front side panel 12 and the back side panel 14 relatively simultaneously to expand the minor side panels 16 and 18 outward along their respective score lines 40 and 44. In another aspect, the user can apply a pressure to both the first side panel 16 and the second side panel 18 relatively simultaneously to expand the major side panels 12 and 14 outward along their respective score lines 46*a*, 46*b* and 42*a*, 42*b*. In still another aspect, the user can apply a pressure relatively simultaneously to all of the side panels 12, 14, 16, and 18 to expand the carton 10 outward along all of the score lines.

Upon expanding the side panels 12, 14, 16, and 18, the major and minor top flaps 22, 24, 26, and 28 can also fold downward adjacent their respective major and minor side panels 12, 14, 16, and 18 and outward along their respective score lines 48, 50, 52, and 54. After the top flaps 22, 24, 26, and 28 are opened, they can be folded downward adjacent their respective side panel before, during, or after expanding the carton 10 along the side panel score lines 40, 42*a*, 42*b*, 44, 46*a*, and 46*b*. Adjusting the carton 10 into its expanded configuration folds the top flaps 22, 24, 26 and 28 outward along their respective score lines 48, 50, 52, and 54. Folding the top flaps 22, 24, 26, and 28 along their respective score lines 48, 50, 52, and 54 generally provides the top flaps 22, 24, 26, and 28 in a folded down formation that is adjacent its respective side panel. In this configuration, the top flaps 22, 24, 26, and 28 can be folded back and held out of the way of the user when accessing the interior of the carton 10 through the opening 56. In one aspect, the top flaps 22, 24, 26, and 28 are generally flush with their adjacent side panel 12, 14, 16, and 18, respectively.

Once the carton 10 is adjusted to its expanded configuration, the carton 10 can remain in its expanded configuration even after the initial application of pressure from the user is removed. The addition of score lines on all four sides, or four panels, of the carton 10, as compared to score lines only along two panels, or alternatively less than all four, can assist in maintaining all four panels in the deformed or expanded state until shifted back to the closed state. The top flaps 22, 24, 26, and 28 of the carton 10 can also remain in the expanded state, which comprises the top flaps 22, 24, 26, and 28 being folded down and outward along their score lines 48, 50, 52, and 54. Similarly, the addition of score lines on all four top flaps, as compared to score lines on less than all four top flaps, such as along only two top flaps, can assist in maintaining the top flaps in a folded position adjacent the respectively attached side panels due to the deformation of each of the side panels and each of the top flaps.

The opening 56 of the carton 10 can be provided with a non-rectangular opening that is much larger than when in the non-expanded state. Thus, the distance from opposite midpoint regions 62, 68, 96 and 98 of the major and minor side panels 12, 14, 16, and 18, respectively, can be increased in the expanded configuration as compared to the closed state. In one aspect, the opening 56 in the expanded configuration can be generally octagonal shaped.

Figure 3:
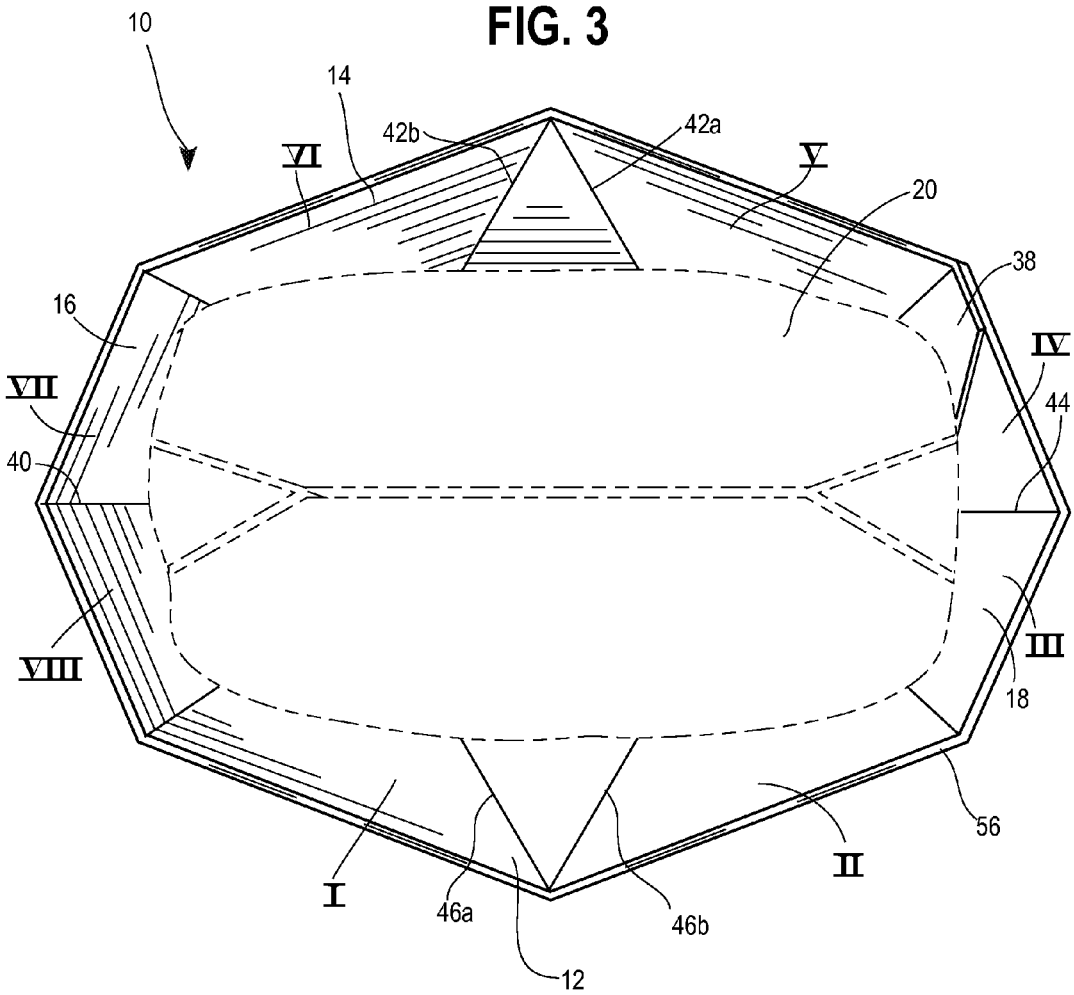
FIG. 3 is a top plan view of the trapezoidal-shaped food carton of FIG. 2.
Figure 4:
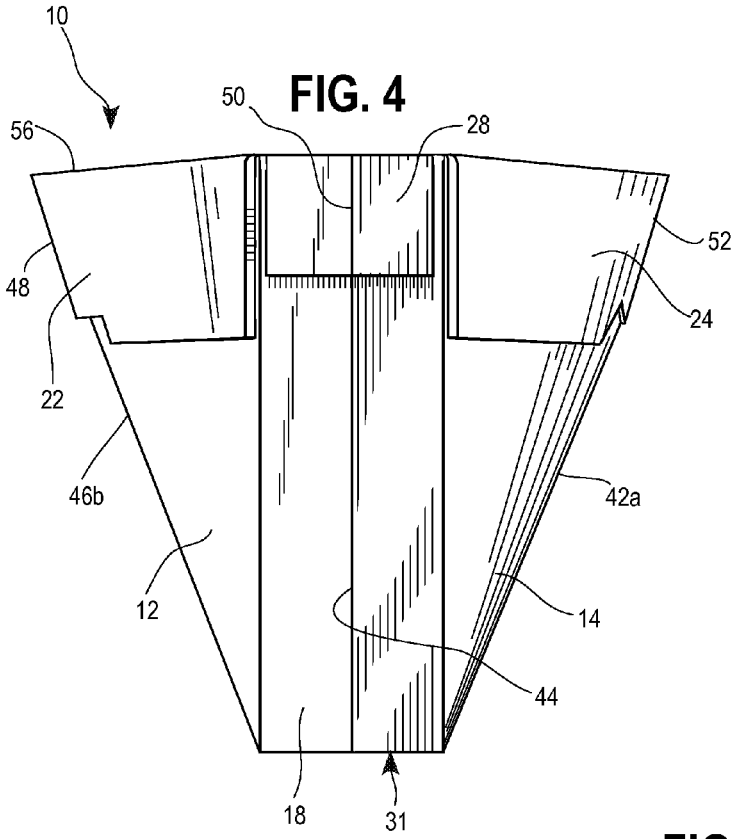
FIG. 4 is a left side view of the trapezoidal-shaped food carton of FIG. 2.
Figure 5:
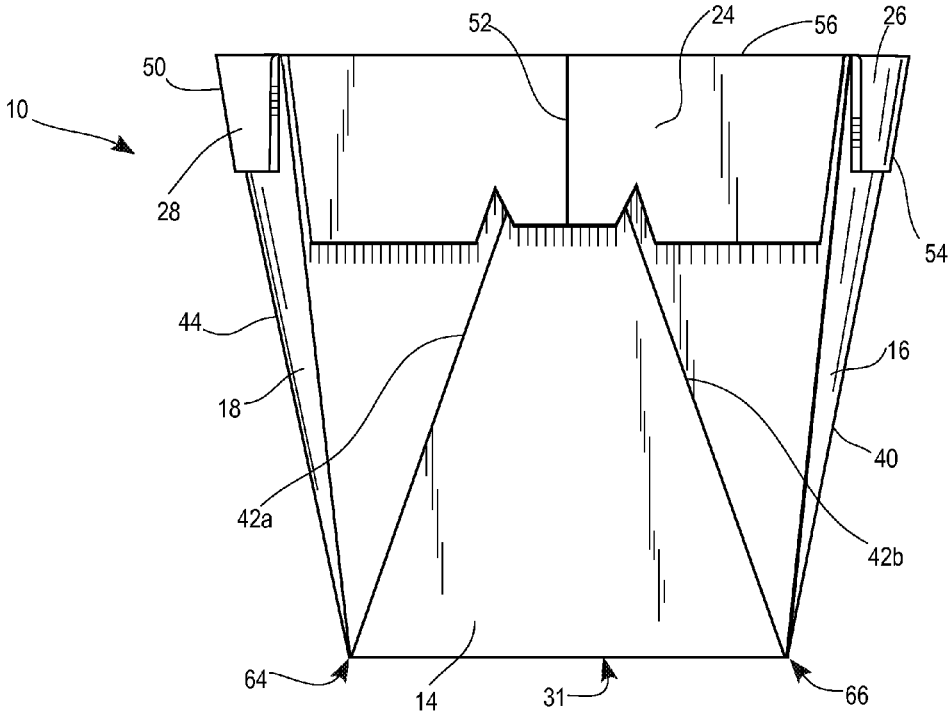
FIG. 5 is a front side view of the trapezoidal-shaped food carton of FIG. 2.

When the carton 10 is in the expanded configuration, the side walls or panels of the carton 10 can also form an octagonal shape similar to the opening 56. In one aspect, the major side panels 12 and 14 and the minor side panels 16 and 18, can fold outward along their respective score lines 40, 42*a*, 42*b*, 44, 46*a*, and 46*b* to form an eight-sided carton 10, as shown in FIG. 3. The front side panel 12 can fold outward along score lines 46*a* and 46*b* to form two side walls I and II. Similarly, the back side panel 14 can fold outward along score lines 42*a* and 42*b* to form two side walls V and VI, generally mirror images of side walls I and II. Likewise, the first side panel 16 can fold outward along score line 46 to form two side walls VII and VIII, and the second side panel 18 can fold outward along score line 44 to form two side walls III and IV, where the side walls III and IV are generally mirror images of VII and VIII.

Additionally, the carton 10 can remain open and in the expanded state even while it is placed upon its side, where it rests upon one of its side panels 12, 14, 16, or 18. The expanded configuration is useful when snacking, such as when a user is inserting their hand through the opening 56 and into the optional liner bag 20 containing the food product 70. The food product 70 contained within the optional liner bag 20 can typically be a "snack-type" food, where a user may not necessarily want to eat all of the food items in one sitting, but rather will eat smaller portions at different times. Thus, the user can insert their hand into the carton opening 56 to access the interior and the liner bag 20 containing the snack food 70. The wider opening 56 in combination with the top flaps 22, 24, 26, and 28 that stay down against their respectively attached side panels 12, 14, 16, or 18 can make it easier for the user to insert their hand and withdraw the desired amount of snack food 70 to consume.

When the user wishes to reclose the carton 10, the carton 10 can be returned to its initial, unexpanded state by applying pressure to the side panels 12, 14, 16 and 18 to shift it to the unexpanded state, which can be a trapezoidal shape having a generally rectangular top 21. The top flaps 22, 24, 26, and 28 may contain a reclose feature that closes the top 21 of the carton 10 during storage until the next use, such as by tucking the flaps under one another. In one aspect, one of the major top flaps 22 and 24 can contain a tab or cutout feature that allows the other of the major top flaps 22 and 24 to be inserted therein. Thus, the two major top flaps 22 and 24 can fit together to form a locked or closed top portion 21, where one flap 24 can tuck under and into the opposite flap 22. However, the opposite configuration may be provided. Alternatively, any other reclose feature common in the art may be used.

Figure 6:
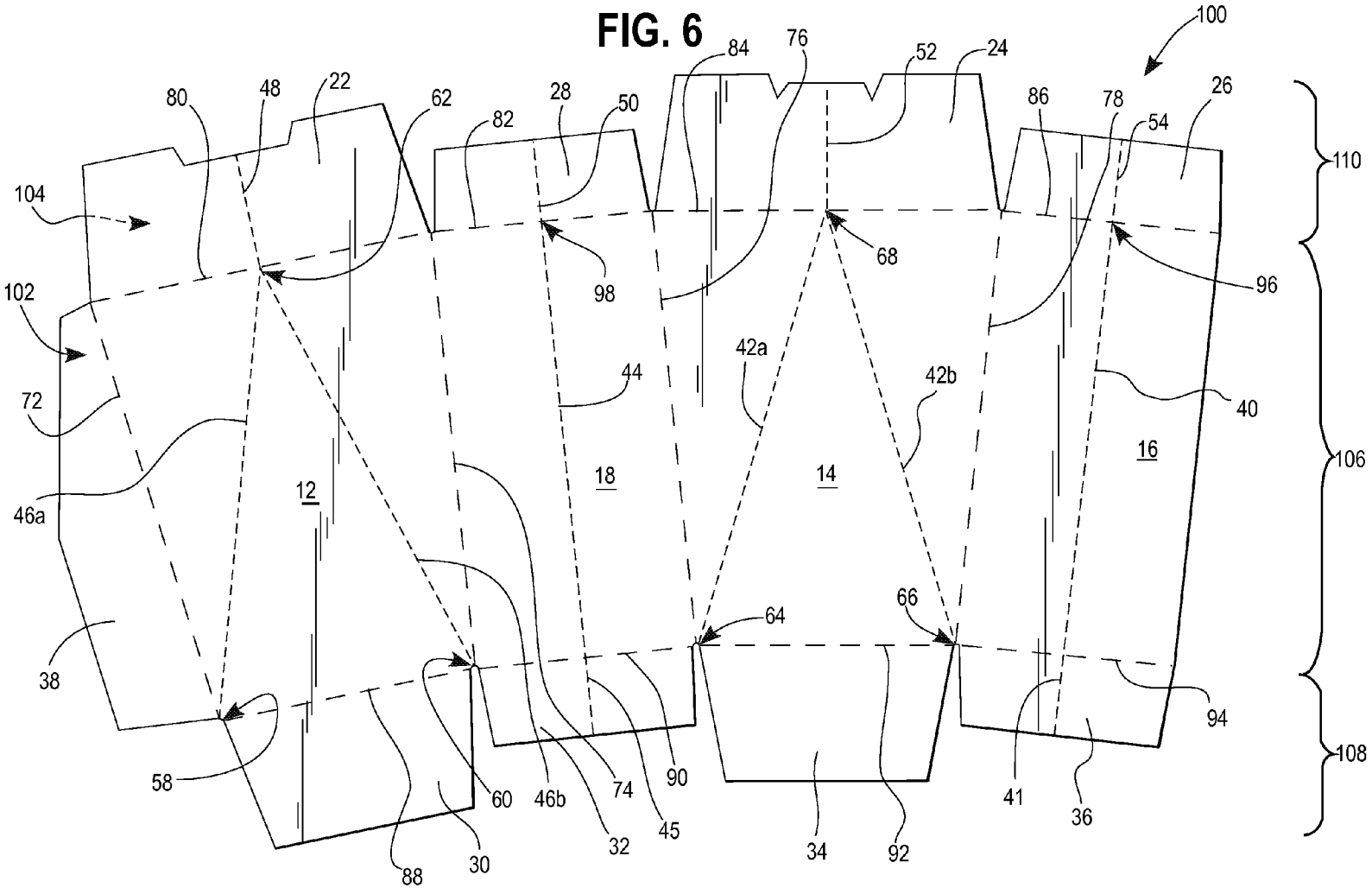
FIG. 6 is a plan view of a trapezoidal-shaped carton blank prior to assembly.

In its unfolded configuration, the carton blank 100, as shown in FIG. 6, is a unitary sheet of paperboard or other similar material with an inner side 102 and an outer side 104. The outer side 104 of the blank 100 may be pre-printed with indicia or other markings. The inner side 102 of the blank 100 defines the interior area of the assembled carton 10, and the outer side 104 of the blank 100 becomes the exterior area of the carton 10.

The fold lines 72, 74, 76, and 78 can divide the unitary carton blank 100 into various side panels 106 such that there are at least four side panels 12, 14, 16, and 18 and a secondary panel 38 in a coplanar arrangement. In one aspect, the fold line 72 divides the secondary side panel 38 and the front side panel 12, the fold line 74 divides the front side panel 12 and the second side panel 18, fold line 76 divides the second side panel 18 and the back side panel 14, and fold line 78 divides the back side panel 14 and the first side panel 16. Other configurations may be possible, such as the secondary side panel 38 may be adjacent the minor side panel 16 rather than the major side panel 12, and so on.

The two larger width panels, the front side panel 12 and the back side panel 14, represent the major side panels and the two smaller width panels, the first side panel 16 and the second side panel 18, represent the minor side panels. The minor side panels 16 and 18 are disposed between the major side panels 12 and 14 when the carton blank 100 is erected into the carton 10. The major side panels 12 and 14 can have a wider upper end than lower end, but the two can generally be sized similarly. The minor side panels 16 and 18 can be sized differently, such as where one of the minor panels 16 or 18 can be narrower than the other. Preferably the carton blank 100 can have a secondary side panel 38 that is of a narrower width than the major side panels 12 and 14 and the minor side panels 16 and 18, but is about the same length as the major side panels 12 and 14 and the minor side panels 16 and 18.

The major side panels 12 and 14 and the minor side panels 16 and 18 can each also contain at least one score line for shifting the fully erected and opened carton 10 into the expanded configuration. The front side panel 12 can have a pair of score lines 46*a* and 46*b* that extend from the adjacent bottom corners 58 and 60 to a midpoint region 62 of the upper end of the front side panel 12. The back side panel 14 can also have a pair of score lines 42*a* and 42*b* that extend from the adjacent bottom corners 64 and 66 to a midpoint region 68 of the upper end of the back side panel 14. The two pairs of score lines 42*a*-42*b* and 46*a*-46*b* can be parallel to one another when the carton blank 100 is erected into the carton 10, and when the back side panel 14 and front side panel 12 are also configured to be parallel to one another. The first side panel 16 can have a single score line 40 which extends along a midpoint region 96 from the upper end to the lower end, and similarly, the second side panel 18 can have a single score line 44 that extends along a midpoint region 98 from the upper end to the lower end.

Adjacent a lower end of the set of side panels 106, including the major side panels 12 and 14 and the minor side panels 16 and 18, can be a set of bottom flaps 108 for forming the bottom 31 of the carton 10 when assembled. The bottom flaps 108 can include a pair of major bottom flaps 30 and 34 and a pair of minor bottom flaps 32 and 36. The major bottom flaps 30 and 34 can be approximately the same width as the lower end of the major side panels 12 and 14, respectively, and can be attached via a fold line thereto; the front bottom flap 30 can be attached via fold line 88 to the front side panel 12 and the back bottom flap 34 can be attached via fold line 92 to the back side panel 14.

The minor bottom flaps 32 and 36 can be approximately the same width as the minor side panels 18 and 16, respectively, and can likewise be attached to a bottom fold line of the minor side panels 18 and 16; the first side bottom flap 36 can be attached via fold line 94 to the first side panel 16 and the second side bottom flap 32 can be attached via fold line 90 to the second side panel 18. The secondary side panel 38 typically does not contain a bottom flap. Optionally, at least one or more bottom flaps may contain a vertical score line. In one aspect, the minor bottom flaps 32 and 36 may each contain a score line 45 and 41, respectively, that can be a continuation of the score line from its adjacent minor side panel 18 and 16, respectively. It is believed that the inclusion of one or more vertical score lines along the bottom flaps can aid in the assembly of the carton 10 from the blank 100.

In one aspect, an overall angle of the blank 100 can comprise an angle from 0 to 30 degrees when measured from the outside edge of side panel 16 to fold line 72. In another aspect, the overall angle of the blank can be about 23 degrees.

The length of the major bottom flaps 30 and 34 can be longer than the length of the minor bottom flaps 32 and 36. In one aspect, the width of each bottom flap 108, parallel to its respective fold line, can decrease between its respective fold line and the opposite end of each bottom flap 108. The decreasing widths of the bottom flaps 108 can result in tapered side edges which provide a clearance or spacing between edges of adjacent bottom flaps 108 when folded generally perpendicular to the side panels 106. The angle of taper between adjacent bottom flaps 108 can be any appropriate angle such that the carton can run adequately on process equipment or be folded by hand. By one approach, the angle of taper between adjacent bottom flaps may be between 0 and about 45 degrees. The angle of taper of each side edge of the bottom flaps may not necessarily be the same as the angle of taper of an adjacent bottom flap side edge. For instance, the angle of taper of the side edges of bottom flap 32 may be greater than or less than the angle of taper of the side edges of adjacent bottom flap 34. Alternatively, the bottom flaps 108 may be provided with minimal or no clearance or spacing between adjacent bottom flaps 108. The adjacent edges of the adjacent bottom flaps 108 may touch but they would not be connected to allow for folding of the bottom flaps 108 into the bottom end 31.

Adjacent an upper end of the set of side panels 106, including the major side panels 12 and 14 and the minor side panels 16 and 18, can be a set of top flaps 110 for forming the top 21 of the carton 10 when assembled. The top flaps 110 can include a pair of major top flaps 22 and 24 and a pair of minor top flaps 26 and 28. The major top flaps 22 and 24 can be approximately the same width as the upper end of the major side panels 12 and 14, respectively, and can be attached via a fold line thereto; the front top flap 22 can be attached via fold line 80 to the front side panel 12 and the back top flap 24 can be attached via fold line 84 to the back side panel 14.

The top minor flaps 26 and 28 can be approximately the same width as the minor side panels 16 and 18, respectively, and can likewise be attached to a top fold line of the minor side panels 16 and 18; the first side top flap 26 can be attached via fold line 86 to the first side panel 16 and the second side top flap 28 can be attached via fold line 82 to the second side panel 18. The secondary side panel 38 typically does not contain a top flap.

The horizontal fold lines 80, 82, 84, and 86, between the top flaps 110 and the side panels 106, can optionally contain intermittent cuts and scores along the fold lines 80, 82, 84, and 86. In one aspect, the fold lines 80, 82, 84, and 86 can contain a series of about 0.5 inch cuts that alternate between a cut and a score line followed by another cut, although any other appropriate length cut can be provided. In the region of the horizontal fold lines 80, 82, 84, and 86 where the score lines of the side panels 106 meet the edge of the horizontal fold lines 80, 82, 84, and 86, a longer length score line may be provided such that a cut line is not placed adjacent the end of a side panel score line. Alternatively, the horizontal fold lines 80, 82, 84, and 86 can comprise all score lines or any other type of variation between scores, cuts, perforations, etc. However, it is believed that by providing an alternating series of cut lines and score lines along the horizontal fold lines 80, 82, 84, and 86, that the series of cuts and score lines assist with keeping the top flaps 110 folded down when the carton 10 is in the expanded position.

The major top flaps 22 and 24 and the minor top flaps 26 and 28 can each contain a score line extending along a midpoint region for shifting the top flaps 22, 24, 26, and 28 from a planar configuration into a non-planar configuration that generally configures to the shape of its adjacent side panel 12, 14, 16 or 18 when the carton 10 is in the expanded configuration. Thus, the front top flap 22 can have a score line 48 that extends between its upper end and lower end along a midpoint region 62. Similarly, the back top flap 24 can have a score line 52, the first side top flap 26 can have score line 54, and the second side top flap 28 can have score line 50, all extending between the upper end and lower end along a midpoint region thereat. Additionally, the top flap score lines 48, 50, 52, and 54 can intersect or contact the score line or intersection of the pair of score lines of the adjacent side panel 12, 14, 16, or 18, such that the top flap score lines 48, 50, 52, and 54 can become an extension of the side panel score lines.

The length of the major top flaps 22 and 24 can be longer than the length of the minor top flaps 26 and 28. In one aspect, the width of each top flap 110, parallel to its respective fold line, can decrease between its respective fold line and the opposite end of each top flap 110. The decreasing widths of the top flaps 110 can result in tapered side edges which provide a clearance or spacing between edges of adjacent top flaps 110 when folded generally perpendicular to the side panels 106. The angle of taper between adjacent top flaps 110 can be any appropriate angle such that the carton can run adequately on process equipment or be folded by hand. By one approach, the angle of taper between adjacent top flaps 110 may be between 0 and 45 degrees. As with the bottom flaps 108, the angle of taper of each side edge of the top flaps 110 may not necessarily be the same as the angle of taper of an adjacent top flap side edge. The intersection point of adjacent top flaps 110 may be positioned at the top edge of adjacent side panels 106 or it may terminate some distance above the top edge of the adjacent side panels 106 with a slit separating the two adjacent top flaps up to the top edge of the adjacent side panel 106.

Turning now to the assembly of the carton blank 100, each of the side panels 106 can be folded along the score lines 72, 74, 76, and 78 to create an interior area having open ends. Where the secondary side panel 38 and the minor side panel 16 overlap, the secondary side panel 38 can be attached to the inner side 102 of the blank 100, such as by adhesive, at the location of the minor side panel 16. Alternatively, if the secondary side panel 38 is attached to the minor side panel, then it would be attached to the major side panel.

After folding the side panels 106 and sealing the secondary side panel 38 to the minor side panel 16, the carton blank 100 has been converted to a partially assembled, erect configuration having open ends. From the erect configuration, the major bottom flaps 30 and 34 and the minor bottom flaps 32 and 36 can be folded along respective fold lines 88, 92, 90, and 94 such that they are substantially normal or almost substantially normal to the respective side panels 106 and can be attached along some or all of the bottom flaps 108 to form the closed bottom 31. Likewise, the major top flaps 22 and 24 and the minor top flaps 26 and 28 can be folded along their respective fold lines 80, 84, 86, and 82 such that they are substantially normal to the respective side panels 106 and can be attached along some or all of the top flaps 110 to form the closed top 21.

The material of construction of the carton 10 can comprise any appropriate material for packaging cartons. In one aspect, a paperboard material or a laminated paperboard material may be used. The carton 10 can have a thickness that is adequate to maintain product and package integrity during manufacturing, distribution, product shelf life and customer usage. By one approach, the thickness can be between about 8 to about 36 mils. In another aspect, the thickness can be about 18 mils. The film of the optional bag liner 20 can also be provided such that it provides the appropriate atmosphere within the carton 10 to keep the product fresh over its standard shelf life. The films for the optional bag liner 20 can comprise oxygen barrier films, moisture barrier films, aroma barrier films or films having combinations of one or more of these barrier properties. Material of construction of the optional bag liner 20 can comprise any appropriate film for packaging the product therein, such as a flexible film or multilayer flexible film. In one aspect, the material of the film may comprise a high density polyethylene coextrusion film, where the other layers may comprise other polymer layers or materials.

The type of food products 70 that can be stored within the bag liner 20 and, as a result, inside of the carton 10, can comprise any type of snack food product that may be eaten in multiple sittings. In one aspect, the snack food types may comprise cookies, crackers, chips, nuts, and the like.

The carton 10 can be any size that is appropriate for the food products 70 being stored therein and, in one aspect, can be at least 1 oz. or larger. In one aspect, the assembled carton 10, in its closed and unexpanded state, can have dimensions of a height of about 7 inches, a width of about 3.4 inches, and an upper length of about 5.3 inches and a lower length of about 4 inches. In another aspect, the assembled carton 10 can have a height that is between about 2 inches and about 12 inches, a width between about 1 inch and about 6 inches, and a length between about 2 inches and about 9 inches.

In one aspect, the unfolded carton blank 100 may generally consist of a sheet from about 6 inches to about 32 inches in width and from about 3.0 inches to about 24 inches in height; the width of the blank 100 also includes the width of the secondary side panel 38. In one aspect, the dimensions are about 17.7 inches by 11.8 inches. The vertical length of the individual major side panels 12 and 14 and the minor side panels 16 and 18, as well as the secondary side panel 38, may be from about 2 inches to about 12 inches, more preferably about 6.6 inches. The major side panels 12 and 14 may have a width at its upper end of about 2 inches to about 9 inches, more preferably about 5.3 inches, where the width at its upper end is larger than the width at its lower end. The minor side panels 16 and 18 may have a width of about 1 inch to about 6 inches. In one aspect, the first side panel 16 may have a slightly smaller width than the second side panel 18, such as the first side panel 16 having a width of about 3.3 inches and the second side panel 18 having a width of about 3.4 inches. The secondary side panel 38 can have the same length as the side panels 12, 14, 16, and 18 or a shorter length, but can have a width that is much smaller. In one aspect, the secondary side panel 38 can have an upper end width from about 0.25 inches to about 2 inches, more preferably about 0.50 inches.

The major bottom flaps 30 and 34 each can have a vertical length of from about 0.50 inches to about 6 inches, more preferably at about 2 inches. The vertical length of the minor bottom flaps 32 and 36 can have a length that is less than that of the major bottom flaps 30 and 34. The width of the minor bottom flaps 32 and 36 is similar to the widths of the minor side panels 18 and 16, respectively. The width of the major bottom flaps 30 and 34 is less than the width of the upper end of its respective major side panels 12 and 14 and is similar to the width of the lower end of the major side panels 12 and 14. Although these dimensions are described for one particular aspect, these dimensions may be varied to obtain other carton sizes depending upon the size liner bag 20 that must be packaged.

From the foregoing, it will be appreciated an expandable carton having folding score lines on all four sides is provided. However, numerous modifications and variations could be made thereto by those skilled in the art without departing from the scope of the carton set forth in the claims. Therefore, the disclosure is not limited to the aspects and embodiments described hereinabove, or to any particular embodiments. Various modifications to the carton could be made which can result in substantially the same carton.

What is claimed is:

1. A trapezoidal-shaped carton having an expandable top formed from a unitary blank, the carton comprising:

a generally rectangular bottom with a pair of major bottom flaps and a pair of minor bottom flaps where the bottom flaps are folded to form a substantially closed bottom;

a plurality of upstanding side panels, including a pair of major side panels, a pair of minor side panels, and a secondary side panel, where the major and minor side panels are upstanding relative to the bottom, the major and minor side panels are attached to the bottom at lower ends thereof and the secondary side panel is attached to one of the major side and minor side panels via a fold and an adjacent one of the major or minor side panels via adhesive, the pair of minor side panels being further apart at their upper end as compared to their lower end;

a first score line along a midpoint region of one of the pair of minor side panels extending from the lower end of one of the pair of minor side panels toward an upper end and a second score line along a midpoint region of the other of the pair of minor side panels extending from the lower end of the other of the pair of minor side panels toward an upper end;

a first pair of score lines on one of the pair of major side panels extending from an adjacent bottom corner region toward a midpoint region of the top end and the other bottom corner region toward the midpoint region of the top end and a second pair of score lines on the other of the pair of major side panels extending from an adjacent bottom corner region toward a midpoint region of the top end and the other bottom corner region toward the midpoint region of the top end;

a top with a pair of major top flaps and a pair of minor top flaps attached to an upper end of the major and minor side panels and folded generally perpendicular thereto, having score lines extending longitudinally along midpoint regions of the pair of major top flaps and the pair of minor top flaps from a top edge region toward a bottom edge region; and an opening defined by upper ends of the major side panels and the minor side panels opposite the bottom, the opening having a closed state where the major and minor top flaps are folded generally perpendicular to the major and minor side panels to form a closed top, and an expanded state where the opening is non-rectangular and the score lines along the major and minor side panels are configured to fold outward and the major and minor top flaps are configured to fold downward adjacent their respective side panel and outward along their respective score lines to increase the distance from opposite midpoint regions of the major and minor side panels as compared to when in the closed state.

2. The carton of claim 1, wherein the carton remains in the expanded state until it is returned to the closed state.

3. The carton of claim 1, wherein the non-rectangular opening is an octagonal shape.

4. The carton of claim 1, wherein the pair of major side panels are further apart at their upper end as compared to their lower end.

5. The carton of claim 1, wherein the carton contains a food product inside of a liner bag.

6. The carton of claim 5, wherein the food product is selected from the group consisting of crackers, cookies, snack chips, nuts, and the like.

7. The carton of claim 1, wherein the carton has four side walls when it is in the closed state and has eight side walls at a perimeter of the opening when the carton is in the expanded state.

8. An expandable food carton comprising:

a generally rectangular bottom with a pair of major bottom flaps and a pair of minor bottom flaps where the bottom flaps are folded to form a substantially closed bottom;

a plurality of side panels upstanding from the bottom, including a pair of major side panels having a wider upper end than a lower end, and a pair of minor side panels, where the major and minor side panels are attached to the bottom at a lower end thereof forming an enclosed interior;

a generally rectangular top with a pair of major top flaps and a pair of minor top flaps where the top flaps are folded generally perpendicular to the major and minor side panels to form a substantially closed top that is openable, the major and minor top flaps each having a score line extending longitudinally between an upper end region and a lower end region thereof and at a midpoint region of the top flap;

a pair of score lines on each of the pair of major side panels and a single score line at a midpoint region of each of the pair of minor side panels; and an expandable configuration having a generally non-rectangular opening defined by upper ends of the major side panels and the minor side panels opposite the bottom, when the major side panels and minor side panels are shifted outward along their respective score lines.

9. The food carton of claim 8, wherein the carton opening has a generally octagonal shape when in the expandable configuration.

10. The food carton of claim 8, wherein the top flaps are configured to fold down adjacent their respective side panel and to shift outward along their respective score lines.

11. The food carton of claim 8, wherein the top flaps are reclosable.

12. The food carton of claim 8, wherein the pair of score lines on each of the major side panels extends upward from each bottom corner toward a midpoint region along an upper end thereof and forms an upside-down V.

13. The food carton of claim 10, wherein the top flaps remain in a folded configuration adjacent their respective side panels while the carton is in the expanded configuration.

14. The food carton of claim 8, wherein the carton opening remains generally non-rectangular while in the expanded configuration, returning to a generally rectangular top when in a closed state.

15. The food carton of claim 8, wherein the pair of minor side panels being further apart at their upper end as compared to their lower end.

16. An expandable reclosable food carton comprising:

a generally rectangular bottom with a first bottom fold line between a first side panel and a first bottom flap, a second bottom fold line between a second side panel and a second bottom flap, a third bottom fold line between a third side panel and a third bottom flap and a fourth bottom fold line between a fourth side panel and a fourth bottom flap, where the bottom flaps are folded and some of the bottom flaps are attached to the other bottom flaps to form a substantially closed bottom;

the plurality of upstanding side panels attached to the bottom at a lower end thereof, including a first side fold line between the first side panel and the second side panel, a second side fold line between the second side panel and the third side panel, a third side fold line between the third side panel and the fourth side panel, and a fourth side fold line between the fourth side panel and a fifth side panel, the fourth side fold line substantially aligned with a free end of the first side panel and attached thereto forming an enclosed interior adjacent the closed bottom and the second and fourth side panels having a wider upper end than a lower end;

a generally rectangular top when in a closed position with a first top fold line between the first side panel and a first top flap, a second top fold line between the second side panel and a second top flap, a third top fold line between the third side panel and a third top flap and a fourth top fold line between the fourth side panel and a fourth top flap, where the top flaps are folded generally perpendicular to upper ends of the side panels to form a substantially closed top;

a pair of score lines on each of the second and fourth side panels and a single score line at a midpoint region of each of the first and third side panels;

a score line on each of the top flaps extending longitudinally between an upper end and a lower end thereof at a midpoint region of the top flaps; and a generally non-rectangular opening defined by upper ends of the side panels opposite the closed bottom when in an expanded state, the expanded state comprising the side panels shifted outward along their respective score lines and further having the top flaps folded down adjacent their respective side panels and shifted outward along their respective score lines.

17. The reclosable food carton of claim 16, wherein the opening remains generally non-rectangular until the carton is returned to the closed position.

18. The reclosable food carton of claim 16, wherein the first bottom flap and the third bottom flap each have a score line extending longitudinally between an upper end and a lower end thereof at a midpoint region of the first and third bottom flaps.

19. The reclosable food carton of claim 16, wherein the carton contains a food product packaged within a bag.

20. The reclosable food carton of claim 16, wherein at least a portion of each of the first top fold line, second top fold line, third top fold line, and the fourth top fold line has cut lines positioned between score lines along the first, second, third, and fourth fold lines.

* * * * *